United States Patent [19]

Levesque

[11] Patent Number: 4,883,044

[45] Date of Patent: Nov. 28, 1989

[54] FIREPLACE ASSEMBLY

[76] Inventor: Thomas A. Levesque, 37 Riverview Ave., Mashpee, Mass. 02649

[21] Appl. No.: 263,866

[22] Filed: Oct. 28, 1988

[51] Int. Cl.[4] ..... F24B 5/00

[52] U.S. Cl. ..... 126/515; 126/525; 126/531

[58] Field of Search ..... 126/515–517, 126/536, 523, 525, 531, 533–535

[56] References Cited

U.S. PATENT DOCUMENTS

| | | | |
|---|---|---|---|
| 4,259,941 | 4/1981 | Gerdes | 126/520 |
| 4,263,889 | 4/1981 | Martenson | 126/506 |

*Primary Examiner*—Carroll B. Dority
*Attorney, Agent, or Firm*—Thomas N. Neiman

[57] ABSTRACT

The assembly is adapted for installation as a free standing unit, a fireplace insert or a whole masonry fireplace. It comprises a primary combustion chamber, similar to a traditional fireplace, with the back wall of the primary combustion chamber being a common wall shared with a second combustion chamber. The secondary combustion chamber is vertical and discharges directly into the hood. The primary combustion chamber is vertical from the grates to the hood, where the flue gasses are forced to travel horizontally the depth of the grates and then enter the hood. The gasses from the primary chamber then mix with the heated gasses from the secondary chamber and reignite to initiate tertiary combustion. An angled grate is used and the grate is even with the intake of the secondary combustion chamber, which causes a horizontal draft to occur over the fire. An air duct, originating out of doors, is attached to the base of the assembly. The entire base of the fireplace is an outside air manifold. Air is preheated in this manifold and is distributed to the grate and the primary combustion chamber, the secondary combustion chamber and a channel up the rear of the assembly. This outside air channel shares a common wall with the secondary combustion chamber. The air moving up this channel is heated and injected into the primary combustion chamber or is released directly into the inside room.

3 Claims, 3 Drawing Sheets

FIREPLACE ASSEMBLY

This invention pertains to heating devices, and in particular to such heating devices which are adapted for free-standing and standard fireplace assemblies that contain a plurality of combustion chambers and use outside air for combustion to heat and disperse outside air either directly into the room or into the firebox to displace previously heated air that normally goes up the chimney in a traditional fireplace.

Fireplaces are well known in the homes of this country. The traditional fireplaces have only one combustion chamber and a single large opening into the interior room which results in very low burn temperatures and large volumes of heated inside air to escape through the large fireplace opening and up the chimney. The low burn temperature cause creosote build up, air pollutants and an inefficient use of wood. The large volumes of heated home air that escape up the chimney are displaced by cold outside air often causing the fireplace to be a negative heat source. From 1975 through 1988, the energy crises years, well over fifty percent of the homes built in the United States had traditional fireplaces installed. These homes could have been equipped with efficient non polluting wood stoves for less money. Clearly, the American consumer prefers the traditional open faced fireplace to wood stoves.

There have been a number of attempts to overcome these difficulties, primarily in the areas of woodstoves, doors blowers and catalytic units. For example, U.S. Pat. No. 4,263,889 issued to Donald S. Martenson for a Combination Fireplace Furnace and Cookstove. This patent shows a firebox that forces a horizontal fire flow to increase heating efficiency via airflow patterns. The U.S. Pat. No. 4,259,941 issued to Heinrich D. Gerdes for a Fireplace Construction for Mobile Homes shows a prefabricated assembly that draws in air from outside of the interior rooms and enters it into the combustion chamber. The difficulties that are inherent in these designs and should be overcome include the following: no unit is presently available that funnels exhausts into a tertiary chamber so that the most efficient burning can take place; none of the previous methods allow large amounts of heated outside air into the combustion chambers without the use of blowers so that higher temperatures can be achieved and more complete burning can take place; and non displace inside air, normally lost up the chimney, with heated outside air. It also should be noted that none of these units show a traditional fireplace approach in that they use doors, blowers and catalytic units or a combination of the three.

Clearly, it is desirable for a fireplace assembly to be able to be installed as a free-standing unit and also to be used in a standard opening for a fireplace. It is the object of this invention, then to set forth an improved fireplace assembly which avoids the disadvantages limitations, above-recited, which obtain in fireplace systems.

It is also the object of this invention to teach a fireplace assembly which has multiple combustion chambers and at the same time will provide for large amounts of outside air volumes to be induced into multiple points of the stove's combustion chambers to replace or displace air lost up the chimney and to enhance combustion. It is another object of this invention to teach a traditional fireplace unit that provides a tertiary combustion capability that promotes efficient burning, reduced emissions, and at the same time, allows a normal looking fire to burn in the primary combustion chamber. Particularly, it is the object of this invention to set forth a fireplace assembly, for installation as a freestanding unit or within a standard fireplace requiring no blowers, doors or catalytic converters, comprising means defining a primary chamber for burning combustible products; said chamber having an angled grate located within for supporting said combustion products; side walls and a rear wall partially surrounding said grate; said walls defining a substantially vertical combustion enclosure having a center portion above said angled grate and adjacent to said rear wall of said enclosure; an upper portion of said chamber for directing rising smoke and gasses; secondary combustion means located behind said rear wall for inducing a secondary source of combustion; damper means above said primary chamber means for forcing a forward horizontal motion for said rising smoke and gasses; a collection chamber; said collection chamber being located above said primary chamber and said secondary combustion means for receiving said rising smoke and gassed from said primary chamber and said gasses from said secondary combustion means to initiate tertiary combustion; a base manifold supply means; said base manifold supply means provides outside air to said angled grates; said base supply manifold further provides outside air around the outside perimeter of said primary combustion chamber and into said secondary combustion means; a rear air channel; said rear air channel being located behind said secondary combustion means for superheating outside air to replace or displace heated inside air normally lost up the chimney; and said rear channel receives outside air from said base supply manifold.

Further objects and features of this invention will become more apparent by reference to the following description taken in conjunction with the accompanying figures, in which.

Figure 1:
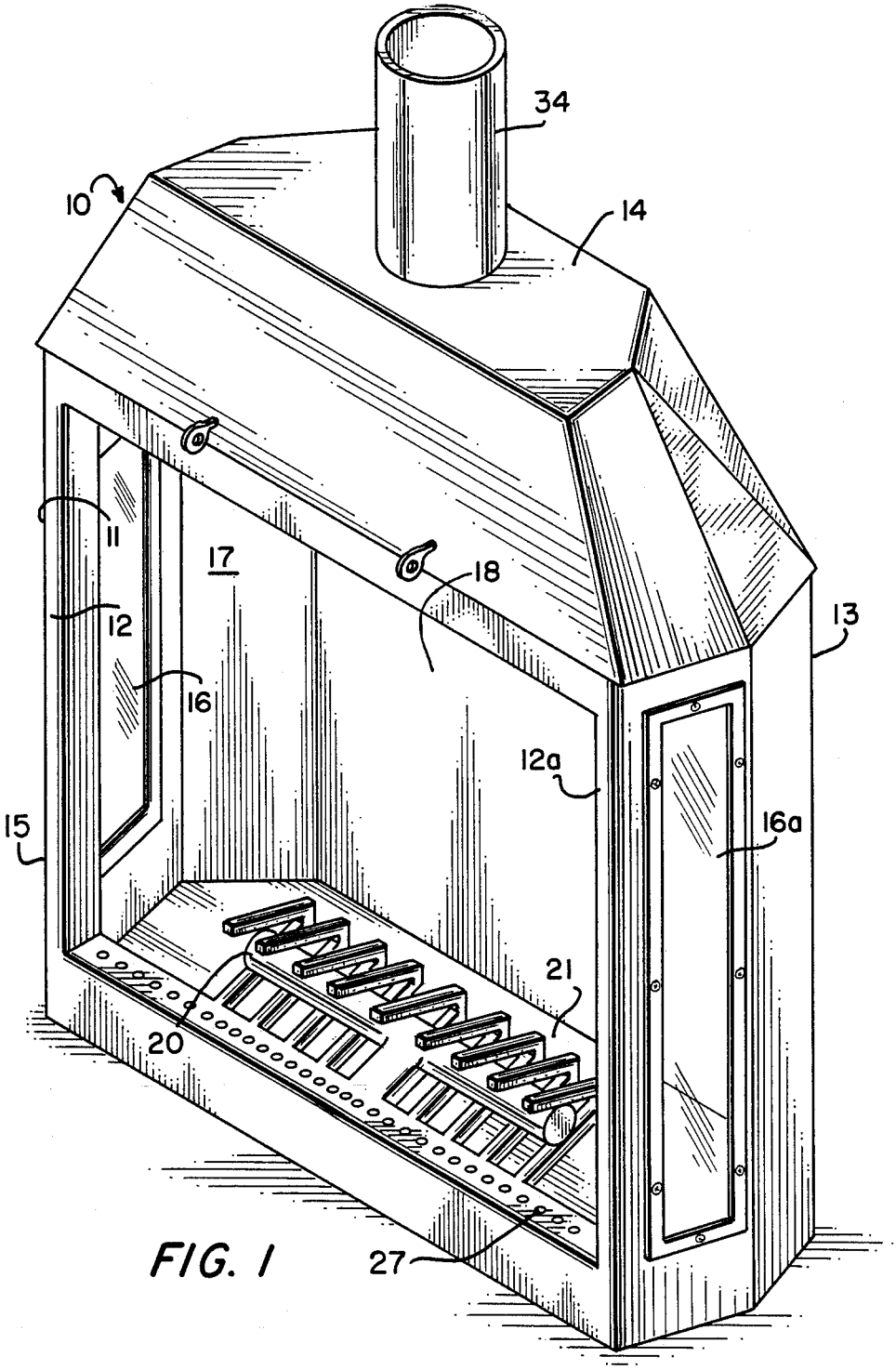
FIG. 1 is a perspective view of the novel multiple combustion chamber fireplace assembly.
Figure 2:
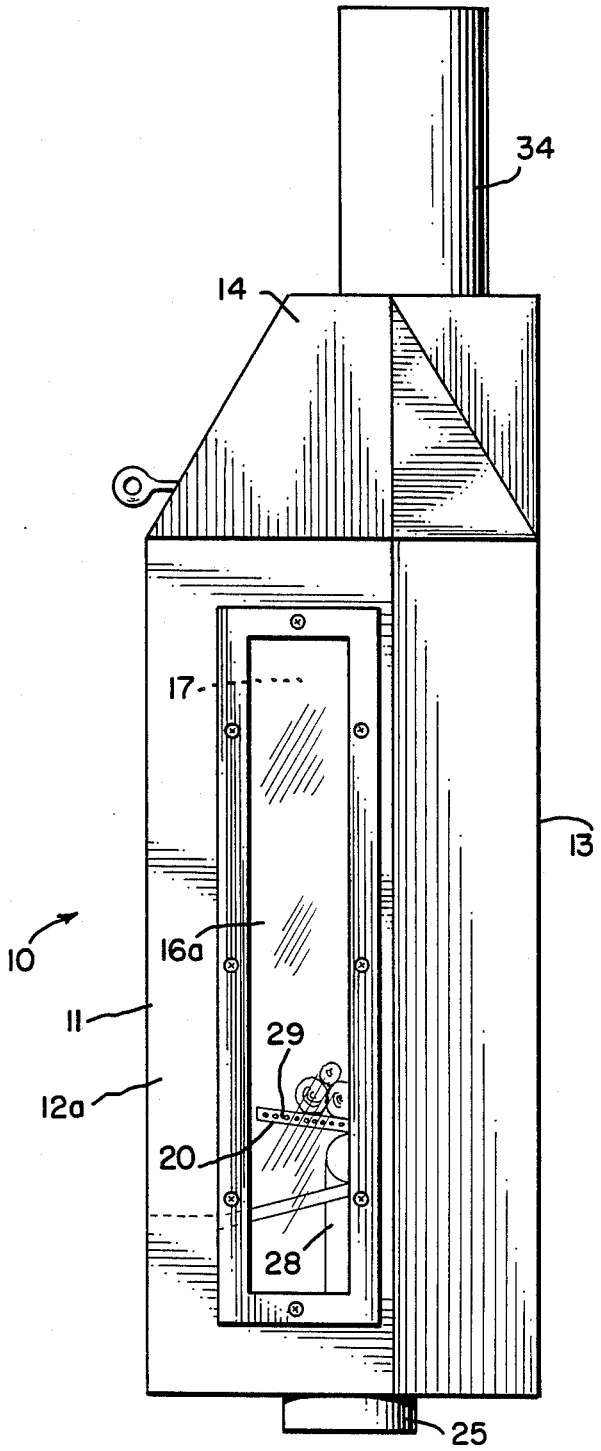
FIG. 2 is a side elevational view thereof.
Figure 4:
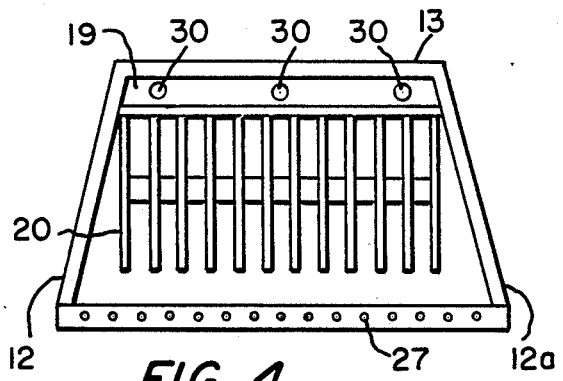
FIG. 4 is a top cross-sectional view of the fireplace assembly taken along line 4–4 of FIG. 3.

As shown in the figures, the multiple combustion chamber fireplace assembly 10 comprises an outer housing 11 having sidewalls 12 and **12*a*, a rear wall 13 and a covering hood 14. A frontal frame 15 is fixed to said side walls 12 and 12*a* and to the covering hood 14. Sidewalls 12 and 12*a* have glass inserts 16 and 16*a* installed in the sidewalls themselves. These sidewalls can be solid, if desired. The primary combustion chamber 17 is located in the open, front portion of the assembly 10. The primary combustion chamber 17 has a back housing 18 at the rear of the primary combustion chamber 17 which separates the primary chamber 17 from the secondary combustion chamber 19. A angled grate 20 is positioned at the base 21 of the primary combustion chamber 17. An angle of approximately 15 degrees from the horizontal position is used to maintain the combustible products positioned at the rear of the primary combustion chamber 17 in order to properly heat and distribute outside air in the combustion chamber and in order to maximize mixing and turbulence in order to enhance combustion. A manually controlled damper 22 is positioned at the top rear of the primary combustion chamber 17**. When the damper 22 is closed, it forces the flame, smoke and gasses forward to the opening 23 at the front of the top 24 of the primary combustion chamber 17. The outside air inlet manifold 25 connected to a duct (not shown) from the outside located under the base 21 of the primary combustion chamber provides outside air to the primary combustion chamber 17, secondary combustion chamber 19 and a bypass heating tube 26.

Figure 3:
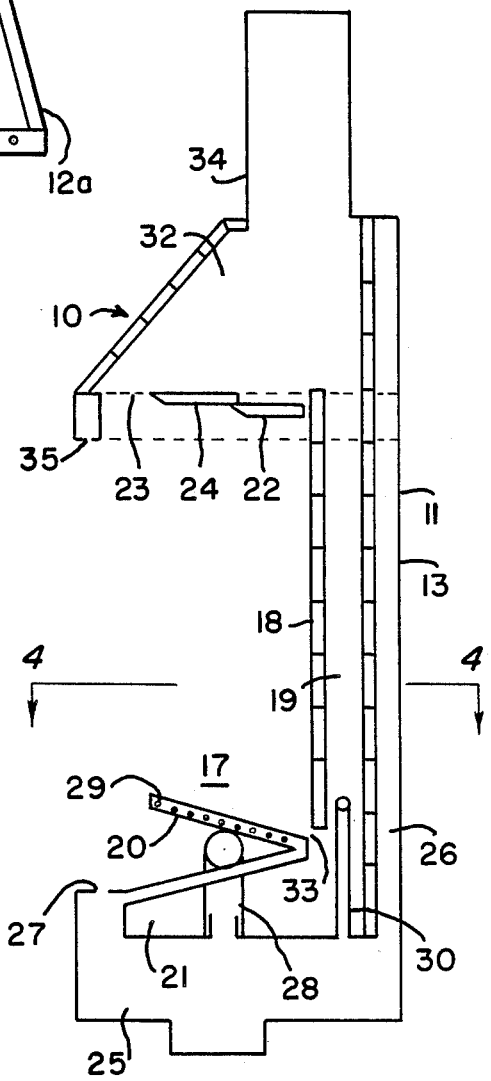
FIG. 3 is a side elevational sectional view of the novel assembly.

Outside air enters the primary combustion chamber 17 and it receives outside air from many directions. The outside air inlet manifold 25 provides outside air through a leading edge port 27 which is a series of holes located around the outside perimeter of the primary combustion chamber 17; through a central conduit 28 at a position just below the grate 20; and through apertures 29 located in the grate 20 itself. This arrangement minimized the amount of ambient air that enters the primary combustion chamber. The secondary combustion chamber 19 receives outside air from the outside air inlet manifold 25 through the secondary combustion chamber conduit 30. Outside air is also provided to a bypass heating tubes 26 which replaces or displaces through air port 35 by means of a duct shown in hatched lines in FIG. 3 ambient air normally lost up the chimney.

A tertiary combustion chamber 32 is positioned at the point where the smoke and hot gasses from the primary combustion chamber 17 and the secondary combustion chamber 19 meet. When the damper 22 is closed, the exhaust products are forced to the opening 23 at the front of the primary combustion chamber. At the same time, more gasses are forced through the secondary combustion chamber at an opening 33 at the rear, lower edge of the back housing 18 of the primary combustion chamber 17 forces more gasses out that opening when the damper is closed. The increased flow through the secondary combustion chamber and the heating of the top of the primary combustion chamber, due to the forward horizontal flow with the damper closed, causes the gasses to ignite in the tertiary combustion chamber. This produces more heat to be radiated from the hood and stores the heat for later use and provides a much cleaner exhaust product to be expelled up the exhaust stock 34. A domestic hot water coil may be positioned in the exhaust stack 34 above the tertiary combustion chamber 32.

In operation, the multiple combustion chamber fireplace assembly is installed as a standard fireplace or as a free-standing unit. The damper is properly positioned and the fire started in the primary combustion chamber. Outside air enters the primary combustion chamber through the leading edge port, the central port, and the grates themselves. Outside air also enters the secondary combustion chamber and the rear heating tube. As the fire builds heat with the damper closed, the fire is forced to the front edge of the primary combustion chamber and increased flow occurs in the secondary combustion chamber. As this happens, higher and higher temperatures occur in the tertiary combustion chamber in the hood of the assembly and ignition occurs. The greater flow of gasses that pass through the secondary combustion chamber increases the amount of heat that is transferred to the rear heating tube. Preheated outside air is injected directly into the firebox or released out the back of the fireplace. This heated outside air either replaces or displaces ambient air normally lost up the chimney.

While I have described my invention in connection with specific embodiments thereof, it is clearly to be understood that this is done only by way of example and not as a limitation to the scope of my invention as set forth in the objects thereof and in the appended claims.

I claim:

1. A fireplace assembly, for installation as a freestanding unit or within a standard fireplace requiring no blowers, doors or catalytic converters, comprising:

means defining a primary chamber for burning combustible products;

said chamber having an angled grate located within for supporting said combustible products;

side walls and a rear wall partially surrounding said grate;

said walls defining a substantially vertical combustion enclosure having a center portion above said angled grate and adjacent to said rear wall of said enclosure;

an upper portion of said chamber for directing rising smoke and gasses;

secondary combustion means located behind said rear wall for inducing a secondary source of combustion;

damper means above said primary chamber means for forcing forward horizontal motion for said rising smoke and gasses;

a collection chamber;

said collection chamber being located above said primary chamber and said secondary combustion means for receiving said rising smoke and gasses from said primary chamber and said gasses from said secondary combustion means to initiate tertiary combustion;

a base manifold supply means;

said base manifold supply means provides outside air to said angle grates;

said base supply manifold further provides outside air around the outside perimeter of said primary combustion chamber and into said secondary combustion means;

a rear air channel;

said rear air channel being located behind said secondary combustion means for superheating outside air and connected to duct means having air openings at the upper front of the combustion chamber said rear channel receives outside air from said base supply manifold.

2. A fireplace assembly, according to claim 1, wherein:

said angled grate comprises a higher front portion and a lower rear portion for forcing said combustible products to the rear of said primary combustion chamber.

3. A fireplace assembly, according to claim 1, wherein:

said base manifold means comprises means for preheating outside air which is admitted thereby into said secondary combustion means.

* * * * *